US006053140A

United States Patent [19]

Feichtinger et al.

[11] Patent Number: 6,053,140

[45] Date of Patent: Apr. 25, 2000

[54] INTERNAL COMBUSTION ENGINE WITH EXTERNALLY SUPPLIED IGNITION

[75] Inventors: Gerhard Feichtinger; Horst Tschetsch, both of Graz, Austria

[73] Assignee: AVL List GmbH, Graz, Austria

[21] Appl. No.: 09/274,307

[22] Filed: Mar. 23, 1999

[30] Foreign Application Priority Data

Mar. 24, 1998 [AT] Austria ..... GM 189/98

[51] Int. Cl.[7] ..... F02P 23/04

[52] U.S. Cl. ..... 123/143 B; 123/406.28

[58] Field of Search ..... 123/406.28, 143 B

[56] References Cited

U.S. PATENT DOCUMENTS

| | | | |
|---|---|---|---|
| 4,416,226 | 11/1983 | Nishida et al. . | |
| 4,434,753 | 3/1984 | Mukainakano et al. | 123/143 B |
| 4,852,529 | 8/1989 | Vowles | 123/143 B |
| 5,113,828 | 5/1992 | Remboski et al. | 123/406.28 |
| 5,328,665 | 7/1994 | Geiger | 123/143 B |
| 5,756,924 | 5/1998 | Early | 123/143 B |

FOREIGN PATENT DOCUMENTS

| | | |
|---|---|---|
| 400769 | 3/1996 | Austria . |
| 001103 | 10/1996 | Austria . |
| 0167608 | 9/1988 | European Pat. Off. . |
| 2849458 | 5/1980 | Germany . |

OTHER PUBLICATIONS

Patent Abstracts of Japan, vol. 17, No. 322, Jun. 18, 1993 of JP 5–33755, Feb. 1993 entitled, "Ignition Device for Internal Combustion Engine".

Patent Abstracts of Japan, vol. 8, No. 40, Feb. 21, 1984 of JP 58–195074, Nov. 14, 1983 entitled, "Ignition Device of Internal–Combustion Engine".

*Primary Examiner*—Erick R. Solis

*Attorney, Agent, or Firm*—Watson Cole Grindle Watson, P.L.L.C.

[57] ABSTRACT

In an internal combustion engine with externally supplied ignition, the compressed air-fuel mixture is ignited, at least partially, with the use of at least one laser beam, which is introduced into a combustion chamber via at least one optical waveguide and is focused onto an ignition location. In order to achieve a simple and compact design, the optical waveguide is positioned in a sealing element bounding the combustion chamber, wherein the sealing element is located in a cutting plane through the combustion chamber and preferably is constituted by a cylinder head gasket.

17 Claims, 2 Drawing Sheets

INTERNAL COMBUSTION ENGINE WITH EXTERNALLY SUPPLIED IGNITION

BACKGROUND OF THE INVENTION

The invention relates to an internal combustion engine with externally supplied ignition, in which a compressed air-fuel mixture is ignited, at least partially, with the use of at least one laser beam, which is introduced into a combustion chamber via at least one optical waveguide and is focused onto an ignition location.

DESCRIPTION OF THE PRIOR ART

In internal combustion engines with a large number of structural openings in the top surface of the combustion chamber, in particular in direct-injection, spark-ignition engines with several intake and exhaust valves, frequent problems arise with regard to the optimum arrangement of the required openings for charge exchange passages, spark plugs, and fuel injectors in the cylinder head. The lack of space will sometimes necessitate compromises in design.

In DE 28 49 458 C2 an internal combustion engine of the above type is presented, in which a radiation pulse formed by a laser beam is passed through a radiation-permeable wall section of the combustion chamber. The disadvantage of this kind of ignition system is that for introduction of the laser beam into the combustion chamber openings or windows must be provided in the wall of the combustion chamber—a measure which generally involves considerable design efforts. U.S. Pat. No. 4,416,226 discloses a similar system, i.e., a laser ignition apparatus for an internal combustion engine, where the laser beam is introduced through an opening in the top surface of the combustion chamber. In this context similar space problems may occur as in the spark-ignition engines discussed above, where a large number of components have entrance openings into the combustion chamber.

In EP 0 167 608 B1 an internal combustion engine is described in which ignition is effected by the introduction of high-energy radiation into the combustion chamber, the lightguides being placed in one variant in a ring-type housing of small overall height, whose interior diameter corresponds to the cylinder diameter. This ring is located between the engine block and the cylinder head, and is sealed by cylinder head gaskets. The ring constituting the housing for the lightguides is composed of two identical halves put together, corresponding grooves being integrated in the opposing surfaces for reception of the lightguides. The halves are made of ceramic material or invar steel, and bonded with the use of a sealant and silver solder. The separate housing for the lightguides constitutes yet another intricate and expensive component. Moreover, as it must be sealed on both sides by cylinder head gaskets, a number of additional sealing surfaces will result, leading to further problems, especially related to differences in surface pressure due to manufacturing tolerances. In EP 0 167 608 B1 the laser beams are not focused but a large number of individual beams are distributed in fan-like manner. The fan-like array is designed to provide a layer penetrated by a plurality of high-power beams forming a network, where at the moment of spark firing an ignition layer is produced which extends basically over the entire cross-section of the cylinder or combustion chamber. From this layer stable flame fronts of corresponding cross-section are designed to propagate towards the walls of the combustion chamber and the front face of the piston. Providing the energy density required for igniting the fuel mixture without focusing of the laser beams has been found difficult and expensive, however.

SUMMARY OF THE INVENTION

It is an object of this invention to avoid such disadvantages and to provide a laser ignition system in an internal combustion engine as described above, whose design should be as simple and compact as possible.

This is achieved in the invention by providing that the optical waveguide be positioned in a sealing element bounding the combustion chamber, which element is located in a cutting plane through the combustion chamber and is preferably constituted by a cylinder head gasket. In this manner a simple laser ignition system is provided which requires very little space and lends itself to backfitting in conventional internal combustion engines.

In a system described in AT 400 769 B optical sensors are located in a sealing element for optoelectronic monitoring of combustion processes in the combustion chamber of an internal combustion engine during operation. The sealing element is formed by a cylinder head gasket, for example.

Another possible solution is given in AT 1 103 U1, where sensor and light emitter leads are located in the cylinder head gasket to permit the use of optoelectronic measuring methods based on laser-induced fluorescence and Raman scattering for quantitative measurement of gaseous and liquid substances in the combustion chambers of stock engines, without undue interference with the combustion chamber geometry.

The optical waveguide enters the combustion chamber in the cutting plane, preferably in approximately radial direction, to provide for a central ignition.

In a very simple variant of the invention focusing of the laser beam is achieved by a locally fused-on end of the optical waveguide at the opening through which the waveguide enters the combustion chamber. By means of the approximately sphere-shaped fiber ends the laser beam entering the combustion chamber is focused onto one point approximately. At the same time the optical waveguide is radially anchored in the cylinder head gasket. It would also be possible to use a system of optical lenses for focusing, where one or more collecting lenses are located at the opening through which the optical waveguide enters the combustion chamber. In a very compact and simple variant of the invention the lens system has at least one spherical lens.

Special preference is given to a variant in which several optical waveguides per cylinder are provided in the sealing element, which are preferably focused onto different ignition locations, the waveguides preferably being subjected to the laser beams either individually or groupwise. In this way the ignition process may be initiated in a controlled manner in several different areas of the combustion chamber at the same time, or distributed over time, if desired, and the number and locations of ignitions can be varied depending on speed and/or load. Preferably, at least one variable of the combustion process is monitored in the combustion chamber with the use of at least one optical waveguide, and is then processed in an evaluation unit. The processed data may be passed on to the ignition control unit as additional parameters, such that the laser ignition is effected making allowance for the specific conditions prevailing in the combustion chamber, such as the actual fuel distribution.

Simultaneously or alternatingly with the laser-induced ignition the optical waveguides may be employed to take measurements in the combustion chamber during operation of the engine, such as detecting fuel droplets, measuring fuel concentrations or determining gas compositions. If required, measuring light may be introduced into the combustion chamber via at least one optical waveguide. As an alternative, the background radiation in the combustion chamber may be utilized for intensity measurements, especially during the detection of fuel droplets.

In order to minimize manufacturing and energy costs for such laser ignition systems, it is considered most advantageous if the laser beam can be produced with the use of a coherent, Q-variable light source, i.e., preferably a pulsed semiconductor laser, which can be optically connected to at least one optical waveguide. The coherent, Q-variable light-source preferably will generate at least two successive laser beam pulses, preferably of different energy density and/or pulse duration. As is described in U.S. Pat. No. 4,416,226, the fuel mixture may be locally excited and a plasma may be produced by a first laser pulse of high energy density. A second, subsequent laser pulse of lower energy density but longer duration will provide the plasma with further energy until ignition of the air-fuel mixture is reliably accomplished.

The laser-induced ignition may be used as main ignition and auxiliary ignition in conjunction with a conventional spark ignition system.

BRIEF DESCRIPTION OF THE DRAWINGS

The invention will now be further described with reference to the accompanying drawings, in which.

Parts with the same functions have the same reference numbers in all variants.

DESCRIPTION OF THE PREFERRED EMBODIMENTS

Figure 1:
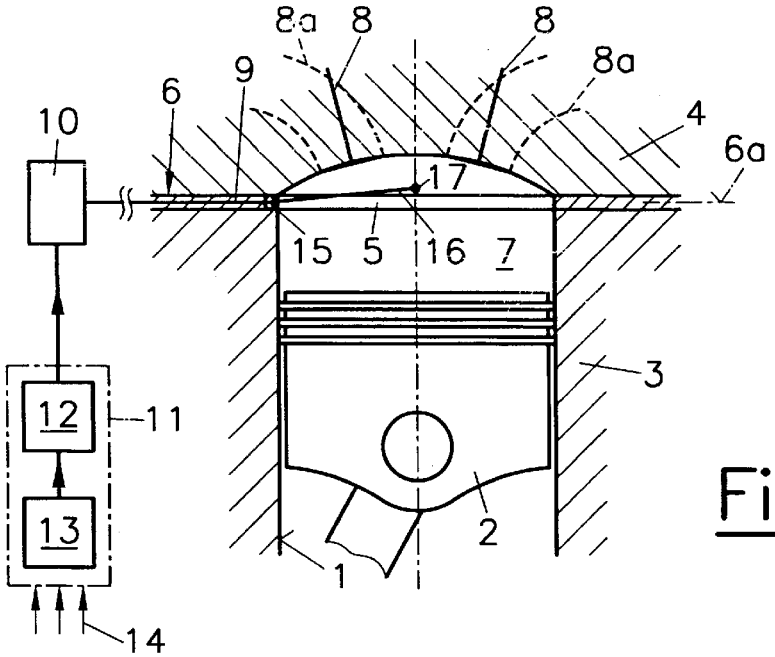
FIG. 1 is a cross-section through a cylinder of the internal combustion engine of the invention, according to a first variant.

FIG. 1 shows a cylinder 1 with a reciprocating piston 2. Between the cylinder block 3 and the cylinder head 4 a sealing element 6 is provided, which is configured as a cylinder head gasket 5. Reference number 6*a* refers to a cutting plane through the combustion chamber 7, whilst 8 refers to charge exchange valves for charge exchange passages 8*a*. Into the cylinder head gasket 5 is integrated an optical waveguide 9, which is optically connected to the combustion chamber 7 in approximately radial direction. The optical waveguide 9 is further connected to a Q-variable, coherent light source 10, such as a pulsed semiconductor laser, which light source 10 is controlled by an ignition control unit 11. The ignition control unit 11 includes a laser control 12 and a timing control 13, the control functions being exerted in dependence of engine operational parameters 14, such as crank angle, speed, engine operating temperature, accelerator position, exhaust quality, measured fuel variables, etc. In the region where the optical waveguide 9 enters the combustion chamber 7 a focusing unit 15 is provided adjacent to the waveguide 9, which will focus the laser beam onto an ignition location 17 upon entrance of the combustion chamber 7 (cf. FIG. 2).

Figure 3A:
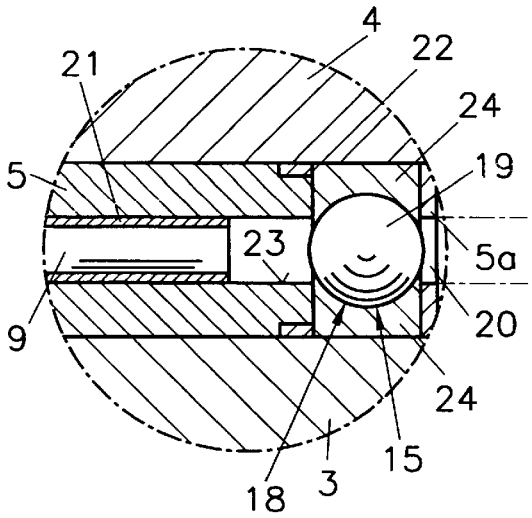
FIGS. 3*a*, 3*b*, 3*c* show detail III of FIG. 2 in three different further variants of the invention.

The focusing unit 15 may comprise an optical lens system 18 with one or more lenses. In the variant shown in FIG. 3*a* the lens system 18 exhibits a spherical lens 19 which is held in a radial bore 20 of a metal ring 5*a* of the cylinder head gasket 5. The spherical lens 19, which may be made from quartz or sapphire, is in optical contact with the waveguide 9, i.e., a glass fiber placed in a metal tube 21. In the variant shown the spherical lens 19 is introduced in a bore 22 of the cylinder head gasket 5 normal to the optical waveguide 9, and is secured on both sides by elastic washers 24, which may be made of teflon and will protect the spherical lens 19 against preload forces in the cylinder head gasket 5. The washers 24 may be attached to a separate support or foil connected to the cylinder head gasket 5, or mounted together with the metal ring 5*a* adjacent to the combustion chamber.

Figure 3B:
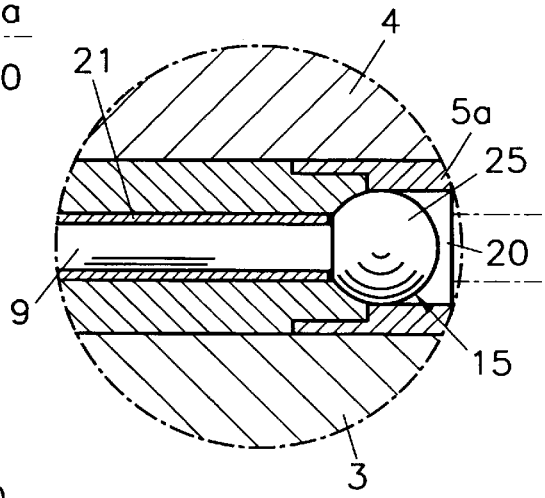

Focusing of the laser beam carried by the optical waveguide 9 may also be achieved by providing the waveguide 9 with a locally fused-on, approximately sphere-shaped end 25, as is shown in FIG. 3*b*. This kind of focusing unit is easy to make and has the additional advantage of the optical waveguide 9 being axially anchored in the cylinder head gasket 5 by means of the fiber end 25.

Figure 3C:
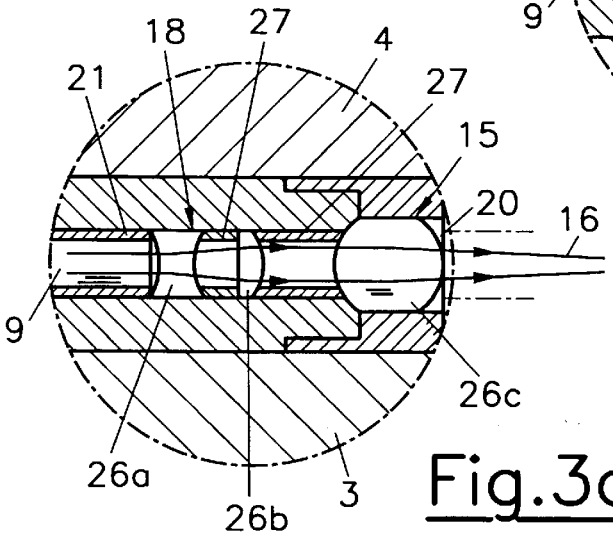

The focusing unit 15 could also comprise a lens system 18 with several, successively arranged optical lenses 26*a*, 26*b*, 26*c*. The lenses 26*a*, 26*b*, 26*c* are separated by spacer sleeves 27, and are fitted into the cylinder head gasket 5*a* from the side of the combustion chamber. This variant is shown in FIG. 3*c*.

Figure 2:
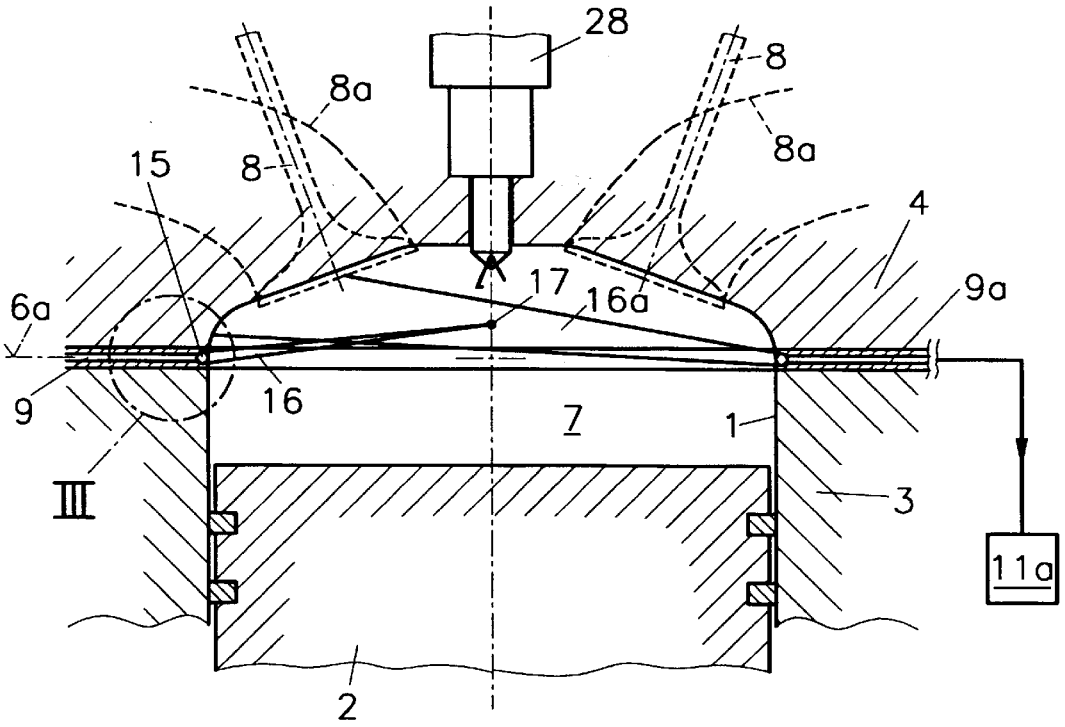
FIG. 2 is a cross-section through an internal combustion engine, in a second variant of the invention.

In the cylinder head gasket 5 several optical waveguides 9, 9*a* may be arranged along its circumference. As is shown in FIG. 2, at least one optical waveguide 9*a* may be utilized to obtain measured variables of the combustion process in the combustion chamber 7, and transmit them to an evaluation unit 11*a* (shown schematically) and/or the ignition control unit 11. The evaluated data may further be used as input variables for regulation of the coherent light source 10. This variant will offer an opportunity of performing an active, optical diagnosis of the combustion chamber, in particular, if measuring light is introduced into the combustion chamber 7 via optical waveguide 9*a*. 16*a* refers to the region in the combustion chamber 7 which is accessible to measurement, and 28 to a fuel injection unit.

Depending on the light source and the type of measuring light and evaluation unit, measurements may be taken as following:

(1) Detection of fuel droplets

By evaluation of the light scattered by fuel droplets, which is supplied by a white light source or a continuous laser and is irradiated into the combustion chamber 7, fuel droplets may be monitored. The coherent light source 10 could also be used to supply the measuring light. The straylight intensity of fuel droplets is perceived as intensity peaks relative to the background radiation.

(2) Determination of fuel concentration

A pulsed ultraviolet laser is used as a light source, for example. The laser-induced fluorescence of the fuel is measured, the light intensity serving as an indicator for the fuel concentration in the measurement region at the time of the laser pulse.

(3) Determination of gas composition

A pulsed ultraviolet laser serves as a light source. By means of suitable sensors the Raman lines of O2, N2, CH, H2O, etc. may be detected via the optical waveguides 9*a*. The intensity ratios between wavelength ranges serve as a measure for the gas composition in the measurement region at the time of the laser pulse.

(4) Monitoring of the changes in gas composition during the engine cycle

The time curve of the spectral intensities may be determined. As a light source a continuous laser may be used.

In this way it will also be possible to perform a precise and quantitative simultaneous measurement of lambda value and residual gas component in the charge of spark-ignition engines utilizing UV laser-induced Raman scattering, possibly in combination with a high-sensitivity, high-speed camera technology. The Raman scattering offers the advantage that the concentrations of fuel, O2, N2, and H2O in the end gas may be measured simultaneously in individual cycles. As a consequence, the lambda value and residual gas component may be determined most accurately, since these quantities will result as ratios of two of the concentrations specified, thus eliminating a number of errors otherwise found in optical measuring methods.

By means of laser-induced fluorescence the fuel distribution over the area of the combustion chamber may be monitored as a function of crank angle and engine cycle. In this way cycle-related fluctuations may be determined.

Figure 4:
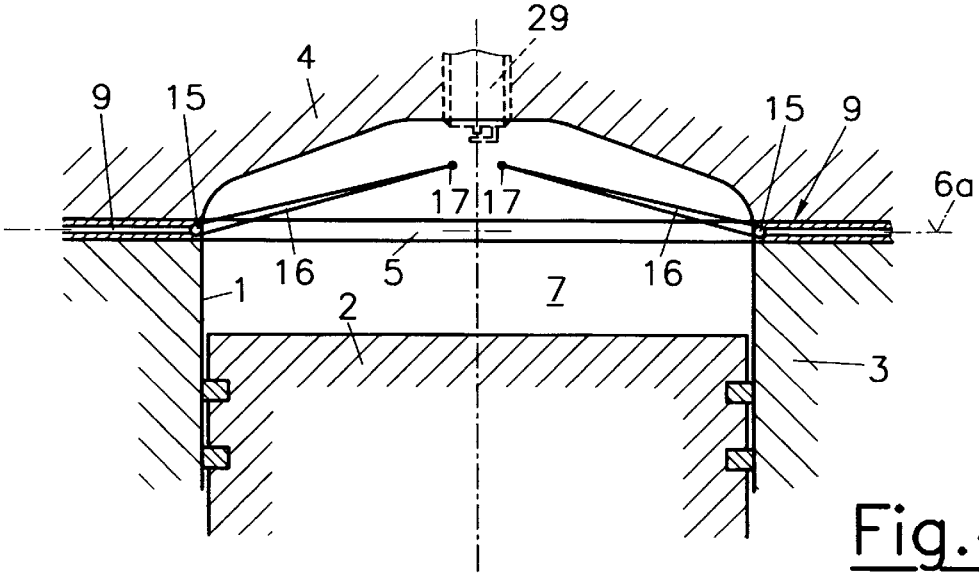
FIG. 4 is a cross-section through a cylinder according to yet another variant of the invention.

In the variant shown in FIG. 4 a number of optical waveguides 9 are provided in the cylinder head gasket 5, which are distributed over its circumference and extend radially towards the combustion chamber 7. The laser beams entering the combustion chamber 7 through the optical waveguides 9 are focused onto different ignition locations 17 and may be activated individually or in groups. Especially in variants, in which the combustion chamber is also monitored and measured as shown in FIG. 2, it will be possible to selectively initiate ignition in those regions of the combustion chamber which actually contain an ignitible mixture. It is evident that the laser ignition proposed by the invention may also be used as auxiliary system for a conventional spark plug 29 indicated in FIG. 4 by a broken line.

Due to the optical waveguides 9 being integrated in the cylinder head gasket 5 no further bores, windows, etc. are required in the cylinder head 4 or in the walls of the cylinder 1. For this reason the laser ignition system lends itself to backfitting in conventional internal combustion engines.

To obtain a reliable ignition in the combustion chamber 7 at low energy expense, a plurality of laser pulses may be utilized for each ignition. For example, a first laser pulse of high energy density will produce a plasma region in the air-fuel mixture, while a second laser pulse of low energy density but longer duration will supply further energy, until ignition takes place. In this manner lasers of relatively low power can be employed.

We claim:

1. An internal combustion engine with externally supplied ignition, in which a compressed air-fuel mixture is ignited, at least partially, with the use of at least one laser beam, which is introduced into a combustion chamber via at least one optical waveguide and is focused onto an ignition location, wherein the optical waveguide including focus device is positioned in a sealing element bounding the combustion chamber, said sealing element being located in a cutting plane through the combustion chamber.

2. An internal combustion engine according to claim 1, wherein the sealing element is a cylinder head gasket.

3. An internal combustion engine according to claim 1, wherein the optical waveguide enters the combustion chamber in an approximately radial direction.

4. An internal combustion engine according to claim 1, wherein said focusing device is a locally fused-on waveguide end at an opening through which the optical waveguide enters the combustion chamber.

5. An internal combustion engine according to claim 1, wherein said focusing device is an optical lens system with at least one collecting lens at the opening through which the optical waveguide enters the combustion chamber.

6. An internal combustion engine according to claim 5, wherein the lens system includes at least one spherical lens.

7. An internal combustion engine according to claim 1, wherein several optical waveguides per cylinder are provided in the sealing element.

8. An internal combustion engine according to claim 7, wherein at least two optical waveguides are focused onto different ignition locations.

9. An internal combustion engine according to claim 7, wherein the optical waveguides are subjected to laser beams either individually or groupwise.

10. An internal combustion engine according to claim 7, wherein at least one variable of the combustion process is monitored in the combustion chamber with the use of at least one optical waveguide, and is then processed in an evaluation unit.

11. An internal combustion engine according to claim 7, wherein measuring light can be introduced into the combustion chamber via at least one optical waveguide.

12. An internal combustion engine according to claim 1, wherein the laser beam can be produced with the use of a coherent, Q-variable light source, which can be optically connected to at least one optical waveguide.

13. An internal combustion engine according to claim 12, wherein the coherent, Q-variable light source is a pulsed semiconductor laser.

14. An internal combustion engine according to claim 12, wherein at least two successive laser beam pulses can be produced by the coherent, Q-variable light-source.

15. An internal combustion engine according to claim 14, wherein said at least two successive laser beam pulses are of different energy density.

16. An internal combustion engine according to claim 14, wherein said at least two successive laser beam pulses are of different pulse duration.

17. An internal combustion engine according to claim 1, wherein ignition by laser beam is effected in addition to spark ignition.

* * * * *